US011646522B2

(12) United States Patent
Nishijima

(10) Patent No.: US 11,646,522 B2
(45) Date of Patent: May 9, 2023

(54) MALE CONNECTOR AND CONNECTOR DEVICE

(71) Applicants: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

(72) Inventor: Seido Nishijima, Mie (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 116 days.

(21) Appl. No.: 17/278,330

(22) PCT Filed: Sep. 18, 2019

(86) PCT No.: PCT/JP2019/036531
§ 371 (c)(1),
(2) Date: Mar. 21, 2021

(87) PCT Pub. No.: WO2020/071119
PCT Pub. Date: Apr. 9, 2020

(65) Prior Publication Data

US 2021/0351539 A1 Nov. 11, 2021

(30) Foreign Application Priority Data

Oct. 4, 2018 (JP) ..... JP2018-189507

(51) Int. Cl.
*H01R 13/44* (2006.01)

(52) U.S. Cl.
CPC ..... *H01R 13/44* (2013.01)

(58) Field of Classification Search
CPC ..... H01R 13/44; H01R 2103/00
See application file for complete search history.

(56) References Cited

U.S. PATENT DOCUMENTS 9,647,372 B2 5/2017 Eckel
11,433,227 B2 * 9/2022 Schultz ..... A61M 39/165
(Continued)

FOREIGN PATENT DOCUMENTS

DE WO 2012110361 * 11/2021 ..... H01R 13/506
JP 2011-238558 A 11/2011
(Continued)

OTHER PUBLICATIONS

International Search Report dated Oct. 21, 2019 for WO 2020/071119 A1 (4 pages).

*Primary Examiner* — Truc T Nguyen
(74) *Attorney, Agent, or Firm* — Venjuris, P.C.

(57) ABSTRACT

A male connector includes male terminals 22 held in a male housing 20, tubular bodies 44 projecting on the male housing 20 and surrounding male connecting portions 24 of the male terminals 22, insulating cover portions 32 for covering tip parts of the male connecting portions 24, female terminal accommodation gaps 46 formed between the male connecting portions 24 and facing surfaces of the tubular bodies 44, and female terminal accommodation holes 48 open in projecting end surfaces and side surfaces of the tubular bodies 44. The female terminal accommodation gaps 46 and the female terminal accommodation holes 48 are configured to allow insertion of female terminals 72 including female connecting portions 70 to be connected to the male con-
(Continued)

necting portions 24 in a mating female connector 14 while hindering hand contact with the male connecting portions 24.

11 Claims, 9 Drawing Sheets

(56) References Cited

U.S. PATENT DOCUMENTS

| | | | | |
|---|---|---|---|---|
| 2011/0053403 | A1 | 3/2011 | Tsuruta et al. | |
| 2017/0170602 | A1* | 6/2017 | Matsumoto | H01R 13/057 |
| 2018/0069335 | A1* | 3/2018 | Hashimoto | H01R 12/712 |
| 2018/0277992 | A1* | 9/2018 | Nishio | H01R 13/5025 |
| 2018/0294600 | A1* | 10/2018 | Loncar | H01R 13/44 |
| 2019/0190183 | A1* | 6/2019 | Kato | H01R 13/113 |
| 2022/0013945 | A1* | 1/2022 | Kobayashi | H01R 13/44 |
| 2022/0283653 | A1* | 9/2022 | Hsiao | G06F 3/041 |

FOREIGN PATENT DOCUMENTS

| | | | |
|---|---|---|---|
| JP | 2016-062699 | A | 4/2016 |
| JP | 2017-216241 | A | 12/2017 |
| JP | 2017-224429 | A | 12/2017 |

* cited by examiner

MALE CONNECTOR AND CONNECTOR DEVICE

CROSS REFERENCE TO RELATED APPLICATIONS

This application is a national phase of PCT application No. PCT/JP2019/036531, filed on 18 Sep. 2019, which claims priority from Japanese patent application No. 2018-189507, filed on 4 Oct. 2018, all of which are incorporated herein by reference.

TECHNICAL FIELD

The present disclosure relates to a male connector provided with a hand-contact preventing function and a connector device using the same.

BACKGROUND

Conventionally, a structure for bringing terminals into conduction by connecting a pair of male and female connectors holding the terminals in housings to each other is adopted in a connector device used in an electrical system of an automotive vehicle or the like. When the male and female connectors are not connected, connecting portions (conductive portions) of the terminals are exposed to outside. Thus, particularly in a connector device or the like for large current, high safety measures such as a hand-contact preventing function for preventing the hand contact of a worker with exposed connecting portions of terminals are required.

For example, in Japanese Patent Laid-Open Publication No. 2016-062699 (Patent Document 1), a structure is proposed in which an insulating member is provided on a tip part of a male connecting portion and a tubular body extending while surrounding the male connecting portion projects further in an axial direction than the tip part of the male connecting portion. According to this, hand contact with the male connecting portion can be prevented by restricting the intrusion of a hand by a tip part of the tubular body and the insulating member provided on the tip part of the male connecting portion.

A connector device in which an opening is formed in a side surface of a tubular body surrounding a male terminal or a housing, and a female connector can be accommodated in an opening formed part of a male connector is proposed in Japanese National Publication of International Patent Application No. 2016-522550 (Patent Document 2).

PRIOR ART DOCUMENT

Patent Document

Patent Document 1: JP 2016-062699 A
Patent Document 2: JP 2016-522550 A

SUMMARY OF THE INVENTION

Problems to be Solved

In the structure of Patent Document 1, an increase in a projecting dimension in the axial direction of the male connector is unavoidable. Additionally, a wire extending from a female terminal of the female connector fit to the male connecting portion of the male connector in the axial direction further projects in the axial direction. Therefore, in the connector device described in Patent Document 1, a large installation space is necessary in the axial direction and vehicle space saving in recent years cannot be dealt with.

In the structure of Patent Document 2, a height in the axial direction of the connector device can be reduced, but the opening provided in the housing or the tubular body of the male connector has a large area to enable the accommodation of the female connector. In this way, the contact of a worker's hand with the male connecting portion exposed to outside through the opening is unavoidable. Therefore, the insulating member is extended from a base part to a tip part of an exposed part of the male connecting portion to prevent hand contact with the male connecting portion.

Accordingly, it is aimed to provide a male connector and a connector device having novel structures capable of reducing a projecting height of a female connector connected to a male connector from the male connector and realizing a hand-contact preventing function of preventing hand contact with a male terminal while advantageously ensuring a cross-sectional area of a male connecting portion by a simple structure.

Means to Solve the Problem

A male connector of the present disclosure includes a male terminal held in a male housing, a tubular body projecting on the male housing and surrounding a male connecting portion of the male terminal, an insulating cover portion for covering a tip part of the male connecting portion, a female terminal accommodation gap formed between the male connecting portion and a facing surface of the tubular body, and a female terminal accommodation hole open in a projecting end surface and a side surface of the tubular body, the female terminal accommodation gap and the female terminal accommodation hole being configured to allow insertion of a female terminal including a female connecting portion to be connected to the male connecting portion in a mating female connector while hindering hand contact with the male connecting portion.

A connector device of the present invention includes the male connector of the present disclosure and a female connector to be connected to the male connector, wherein the female connector includes a female terminal having a female connecting portion to be connected to the male connecting portion of the male terminal and a female housing for accommodating the female terminal, and the female housing includes a male connecting portion inserting portion and a tubular body inserting portion and the female terminal including the female connecting portion is held positioned between the male connecting portion inserting portion and the tubular body inserting portion.

Effect of the Invention

According to the male connector and the connector device of the present disclosure, a projecting height of the female connector connected to the male connector from the male connector can be reduced. Further, a hand-contact preventing function of preventing hand contact with the male terminal can be realized while a cross-sectional area of the male connecting portion is advantageously ensured by a simple structure.

DETAILED DESCRIPTION TO EXECUTE THE INVENTION

Description of Embodiments of Present Disclosure

Figure 1:
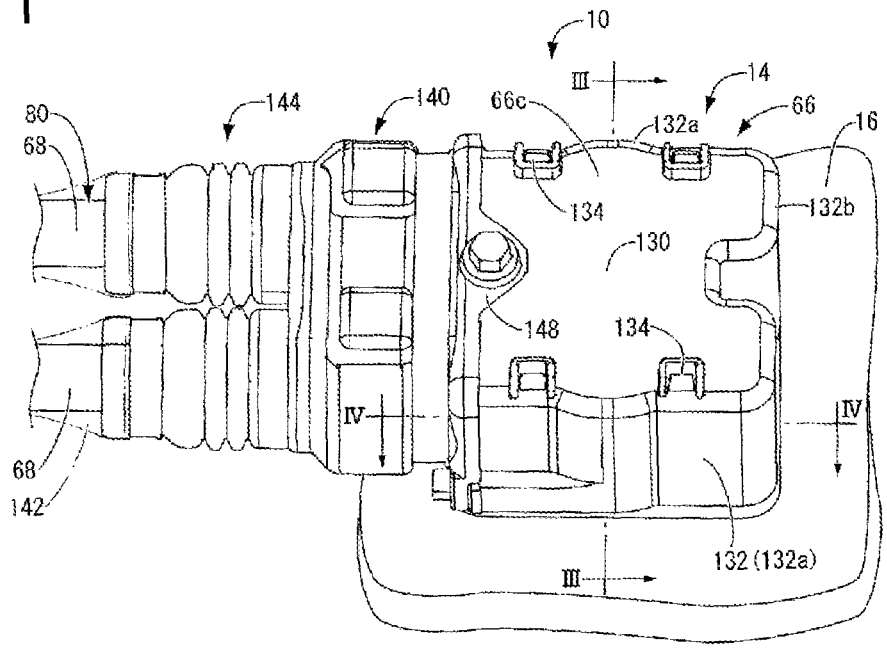
FIG. 1 is a perspective view showing a connector device according to one embodiment of the present disclosure.
Figure 2:
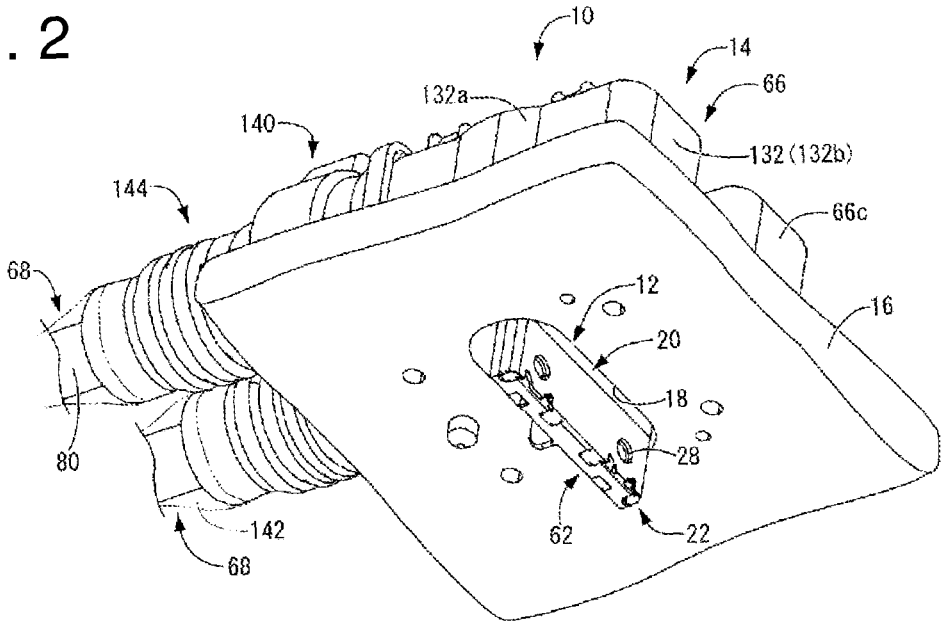
FIG. 2 is a perspective view of FIG. 1 viewed from a bottom surface side.

First, embodiments of the present disclosure are listed and described.

(1) A male connector of the present disclosure includes a male terminal held in a male housing, a tubular body projecting on the male housing and surrounding a male connecting portion of the male terminal, an insulating cover portion for covering a tip part of the male connecting portion, a female terminal accommodation gap formed between the male connecting portion and a facing surface of the tubular body, and a female terminal accommodation hole open in a projecting end surface and a side surface of the tubular body, the female terminal accommodation gap and the female terminal accommodation hole being configured to allow insertion of a female terminal including a female connecting portion to be connected to the male connecting portion in a mating female connector while hindering hand contact with the male connecting portion.

According to the male connector of the present disclosure, the female terminal accommodation hole open in the projecting end surface and the side surface is provided in the tubular body surrounding the male connecting portion, and the female terminal accommodation gap is formed between the male connecting portion and the facing surface of the tubular body. In this way, the female terminal can be accommodated in an axially projecting region of the male connecting portion, and projecting dimensions of the female terminal and the female connector including the female terminal from the male connector can be reduced. Therefore, a height reduction of a connector device can be advantageously realized.

Further, the female terminal accommodation gap and the female terminal accommodation hole are dimensioned to allow the insertion of the female terminal including the female connecting portion to be connected to the male connecting portion in the female connector while hindering hand contact with the male connecting portion. Thus, even if the female terminal accommodation hole open in the side surface of the tubular body is formed, a hand comes into contact with the tubular body without being able to pass through the female terminal accommodation hole. In this way, hand contact with the male connecting portion from the female terminal accommodation hole is reliably prevented. Further, the tip part of the male connecting portion is covered by the insulating cover portion. The outer peripheral surface of the male connecting portion is surrounded across the female terminal accommodation gap dimensioned to hinder hand contact. In this way, even if a hand approaches from a tip side of the male connecting portion, the hand comes into contact with the tip surfaces of the insulating cover portion and the tubular body to hinder contact with the male connecting portion. Therefore, a reduction in the projecting height of the female connector from the male connector and a height reduction of the connector device can be advantageously realized by a simple structure.

In addition, the insulating cover portion may be provided at least on the tip part of the male connecting portion. Thus, the structure of the male terminal can be simplified as compared to a conventional structure in which an insulating member needs to extend from a base end to a tip part of a male connecting portion. Further, a cross-sectional area of the male connecting portion in the male terminal can also be advantageously ensured. In this way, a cost reduction of the male connector, a reduction in the diameter of the male terminal and, eventually, the miniaturization of the male connector can be advantageously realized.

(2) Preferably, a part of the male connecting portion of the male terminal except the tip part is not covered by an insulating member.

It is possible not to cover the entire outer peripheral surface of the male connecting portion including a part exposed to outside from the female terminal accommodation hole of the tubular body by the insulating member. In this way, a contact area of the male connecting portion and the female connecting portion of the female terminal can be advantageously ensured, and conduction safety can be improved. In addition, a cross-sectional area of the male connecting portion itself can be more advantageously ensured, which can more advantageously contribute to a reduction in the diameter of the male connecting portion and the miniaturization of the male connector.

(3) Preferably, a pair of contact preventing ribs are provided which project toward an outer peripheral side of the tubular body from a pair of circumferential edge parts defining the female terminal accommodation hole in the tubular body, and the female terminal accommodation hole is configured to include the pair of contact preventing ribs.

The female terminal accommodation hole is configured to include the pair of contact preventing ribs respectively projecting toward the outer peripheral side from the pair of circumferential edge parts defining the female terminal accommodation hole. In this way, a hand can be kept more away from the male terminal by projecting dimensions of the contact preventing ribs. By providing the contact preventing ribs, a large separation dimension in a circumferential direction of the pair of circumferential edge parts in the female terminal accommodation hole can be ensured while the hand-contact preventing function is ensured. Further, a degree of freedom in designing the female terminal of the mating partner of the male connector can be improved. By providing the pair of contact preventing ribs, the rigidity and durability of the tubular body reduced by providing the female terminal accommodation hole in the form of a cutout can also be improved.

(4) Preferably, the male housing includes a body portion for accommodating a base end part of the male terminal, the body portion has a female connector mounting surface on which the female connector is to be mounted, the male connecting portion of the male terminal and the tubular body surrounding the male connecting portion are provided to project in a central part of the female connector mounting surface, a male-side housing fitting portion projecting in the same direction as the tubular body is provided to project on a peripheral edge part of the female connector mounting surface, and a region between the tubular body and the male-side housing fitting portion serves as a female housing accommodating portion for accommodating a female housing of the female connector.

The body portion of the male housing for accommodating the base end part of the male terminal has the female connector mounting surface, and the male connecting portion and the tubular body are provided to project outward from the female connector mounting surface. Further, the housing fitting portion is provided to project on the peripheral edge part of the female connector mounting surface, and the female housing accommodating portion is formed, utilizing a space between the tubular body and the housing fitting portion. In this way, in addition to the female terminal, the female housing of the female connector for accommodating the female terminal can also be accommodated in axially projecting regions of the male connecting portion and the tubular body. The projecting dimension of the female connector including the female terminal from the male connector can be reliably reduced, and a height reduction of the connector device can be advantageously realized.

(5) Preferably, a projecting dimension of the male-side housing fitting portion from the female connector mounting surface is larger than projecting dimensions of the male connecting portion and the tubular body from the female connector mounting surface, and the male-side housing fitting portion is fit to a female-side housing fitting portion provided in the female housing, whereby the female terminal of the female connector is positioned in the female terminal accommodation gap and the female terminal accommodation hole.

By making the projecting height of the male-side housing fitting portion larger than those of the male connecting portion and the tubular body, the fitting of the male-side housing fitting portion of the male connector to the female-side housing fitting portion of the female connector can be guided. As a result, the female terminal can be advantageously and easily positioned into the female terminal accommodation gap and the female terminal accommodation hole. Even if the female terminal accommodation gap and the female terminal accommodation hole are dimensioned to be narrow to prevent hand contact, an assembling operation of the male and female connectors can be stably realized.

(6) A connector device of the present disclosure includes the male connector according to any one of (1) to (5) described above, and a female connector to be connected to the male connector, wherein the female connector includes a female terminal including a female connecting portion to be connected to the male connecting portion of the male terminal and a female housing for accommodating the female terminal, and the female housing includes a male connecting portion inserting portion and a tubular body inserting portion and the female terminal including the female connecting portion is held positioned between the male connecting portion inserting portion and the tubular body inserting portion.

According to the connector device of the present disclosure, the male connecting portion inserting portion and the tubular body inserting portion are formed in the female housing constituting the female connector to be connected to the male connector of the present disclosure, and the female connecting portion of the female terminal is held positioned between the male connecting portion inserting portion and the tubular body inserting portion. In this way, the insertion of the male connecting portion and the tubular body into the female housing of the female connector is allowed by assembling the female connector from above in an axial direction of the male connecting portion and the tubular body of the male connector. As a result, the female terminal including the female connecting portion held positioned between the male connecting portion inserting portion and the tubular body inserting portion can be accommodated in the female terminal accommodation gap and the female terminal accommodation hole of the male connector. Therefore, the compact connector device reduced in height can be advantageously realized by a simple structure.

(7) In (6) described above, preferably, the female connecting portion of the female terminal and a region near the female connecting portion are accommodated in the female terminal accommodation gap and the female terminal accommodation hole provided in the male connector, and a wire connecting portion of the female terminal is accommodated outside the tubular body.

The female connecting portion that can be formed to be relatively thin and a region near the female connecting portion in the female terminal are accommodated into the female terminal accommodation gap and the female terminal accommodation hole. The wire connecting portion that is formed to be relatively thick is accommodated outside the tubular body. In this way, dimensions of the female terminal accommodation gap and the female terminal accommodation hole can be maximally reduced while the connection of the male connecting portion and the female connecting portion of the female terminal is allowed. Therefore, the hand-contact preventing function can be advantageously realized.

(8) In (7) described above, preferably, the female connecting portion of the female terminal is accommodated into the female terminal accommodation gap and pressed into contact with an outer peripheral surface of the male connecting portion, and a wire extending from the wire connecting portion of the female terminal extends outwardly of the female terminal accommodation hole in a direction orthogonal to a projecting direction of the tubular body.

The female connecting portion to be pressed into contact with the outer peripheral surface of the male connecting portion can be accommodated into the female terminal accommodation gap. Further, the wire extending from the wire connecting portion of the female terminal extends outward in an axis-orthogonal direction orthogonal to the projecting direction of the tubular body from the female terminal accommodation hole. In this way, the extension of the wire extending from the female connector axially upwardly of the tubular body of the male connector and the like can be avoided. A height reduction of the entire connector device using the male connector can be more advantageously realized, utilizing the female terminal accommodation gap and the female terminal accommodation hole.

(9) In (8) described above, preferably, the female terminal of the female connector includes a male terminal insertion tube portion constituting the female connecting portion by an inner surface to which the male connecting portion is to be press-fit, a pair of overlapping plate portions connected to a pair of first separated portions provided by separating one part in a circumferential direction of the male terminal insertion tube portion over an entire length in an axial direction, separated from each other and projecting outward, and a biasing means held in the female terminal for biasing the pair of overlapping plate portions in a direction to overlap the overlapping plate portions each other and holding the male terminal insertion tube portion in a diameter reduced state, the male terminal insertion tube portion is resiliently deformed in a diameter enlarging direction against a biasing force of the biasing means and the male connecting portion is allowed to be press-fit into the male terminal insertion tube portion when the male connecting portion is press-fit into the male terminal insertion tube portion, and the biasing means of the female terminal is accommodated outside the tubular body of the male connector.

The female connecting portion of the female terminal is constituted by the male terminal insertion tube portion. The male terminal insertion tube portion includes the pair of first separated portions separated over the entire length in the axial direction in one circumferential part. The pair of overlapping plate portions separated from each other and projecting outward are connected to the pair of first separated portions. The biasing means held in the female terminal biases the pair of overlapping plate portions in such a direction that the overlapping plate portions approach and are overlapped each other. In this way, the pair of first separated portions of the male terminal insertion tube portion are resiliently deformed in the direction to be brought closer to each other and overlapped, and the male terminal insertion tube portion is held in the diameter reduced state by the biasing force of the biasing means. Besides, when the male connecting portion is press-fit into the male terminal insertion tube portion, the male terminal insertion tube portion is resiliently deformable in the diameter enlarging direction against the biasing force, wherefore the male connecting portion is allowed to be press-fit into the male terminal insertion tube portion. In the female terminal of the present disclosure, a force in the diameter reducing direction is applied to the male terminal insertion tube portion by the biasing force of the biasing means. Therefore, the female connecting portion configured by the inner surface of the male terminal insertion tube portion can be pressed into contact with the male connecting portion press-fit into the male terminal insertion tube portion with a large contact pressure.

In addition, since the biasing means is held in the female terminal, a separate spring member or the like needs not be mounted to sandwich a connected part after the male terminal is connected to the female terminal. Therefore, an operation process can be simplified, and a high contact pressure between the male and female terminals can be realized by excellent workability.

Further, when the male connecting portion is press-fit into the male terminal insertion tube portion, the resilient deformation of the male terminal insertion tube portion in the diameter enlarging direction is allowed against the biasing force of the biasing means. In this way, a press-contact state can be stably maintained while an insertion force in inserting the male connecting portion into the female connecting portion of the female terminal is advantageously reduced.

Moreover, the biasing means of the female terminal that is relatively large in size is accommodated outside the tubular body of the male connector. Thus, even in the case of employing the female terminal of the present disclosure, it is not necessary to make the dimensions of the female terminal accommodation gap and the female terminal accommodation hole provided in the tubular body of the male connector large. Therefore, both an improvement of the press-contact state of the male and female terminals and a reduction of the insertion force can be achieved.

(10) In (8) or (9) described above, preferably, the male connector is configured by using the male connector of the fifth mode of the present invention relating to the male connector, the female housing is formed with a female-side housing fitting portion to which the male-side housing fitting portion is to be fit, and when the male connector and the female connector are connected, the male-side housing fitting portion and the female-side housing fitting portion are fit, whereby the female terminal of the female connector is positioned with respect to the female terminal accommodation gap and the female terminal accommodation hole of the male connector and the male connecting portion inserting portion and the tubular body inserting portion of the female connector are positioned with respect to the male connecting portion and the tubular body of the male connector.

When the male connector and the female connector are connected, the male-side housing fitting portion and the female-side housing fitting portion are first fit. In this way, the female terminal of the female connector is positioned with respect to the female terminal accommodation gap and the female terminal accommodation hole of the male connector. Further, the male connecting portion inserting portion and the tubular body inserting portion of the female connector are positioned with respect to the male connecting portion and the tubular body of the male connector. A guiding function by the mutual fitting of the male-side housing fitting portion and the female-side housing fitting portion is achieved, and the insertion of each of the female terminal, the male connecting portion and the tubular body into a narrow gap is stably realized. Both a height reduction of the connector device and ease of fitting are advantageously realized by a simple structure.

Details of Embodiment of Present Disclosure

Specific examples of a male connector and a connector device of the present disclosure are described with reference to the drawings below. Note that the present disclosure is not limited to these illustrations and is intended to be represented by claims and include all changes in the scope of claims and in the meaning and scope of equivalents.

FIGS. 1 to 6 show a connector device 10 as one embodiment of the present disclosure. The connector device 10 is illustrated to be applied to a connector for supplying power to an unillustrated in-vehicle device (e.g. motor, inverter or the like mounted in a hybrid vehicle or the like). The connector device 10 includes a male connector 12 to be fixed to a device side and a female connector 14, the connectors 12, 14 being connectable to each other. This device includes a mounting body 16 made of metal and having a shielding function, and the mounting body 16 is formed with a connector mounting hole 18 (see FIG. 2) penetrating through the mounting body 16 in an in-out direction. Note that, in the following description, an upper side means an upper side in FIGS. 1 and 3, a lower side means a lower side in FIGS. 1 and 3, a front side means a right side in FIGS. 1 and 4 and a rear side means a left side in FIGS. 1 and 4. Further, a longitudinal direction means a lateral direction in FIGS. 1 and 4, and a width direction means a lateral direction in FIG. 3. Further, the mounting body 16 is shown in an imaginary line in FIGS. 5 and 6 to facilitate understanding.

Figure 3:
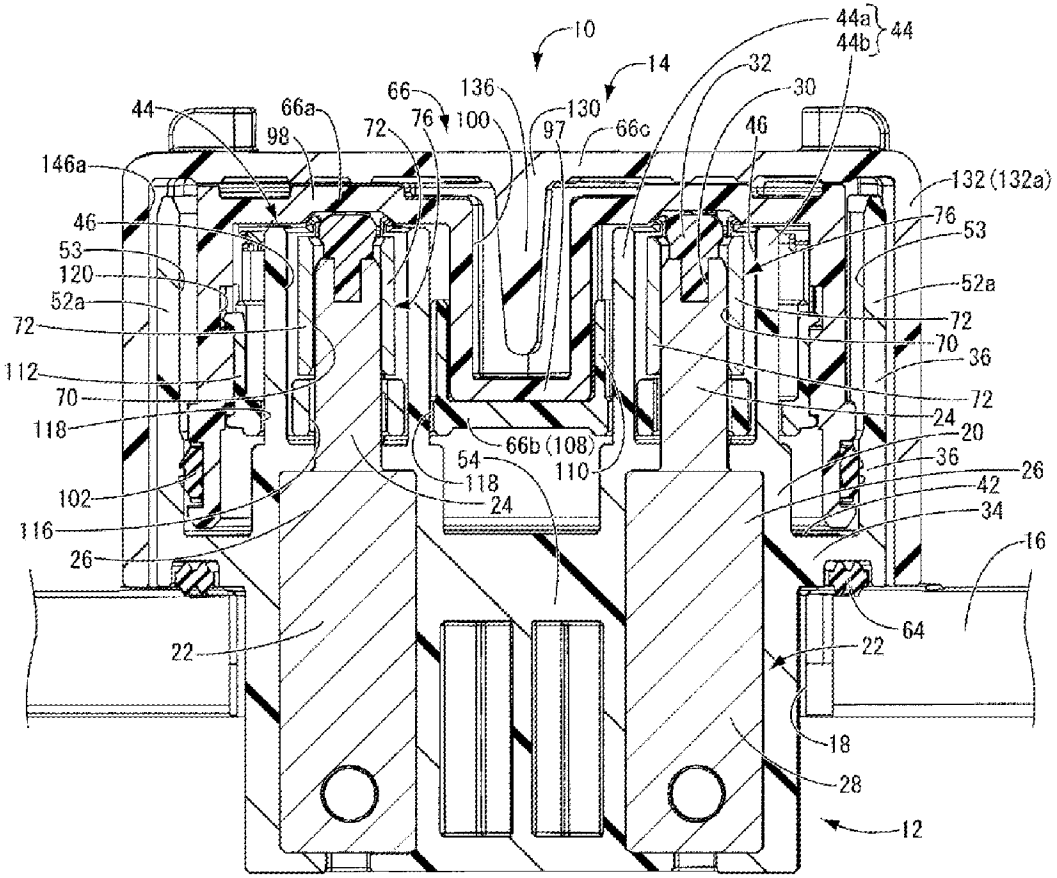
FIG. 3 is an enlarged section along in FIG. 1.
Figure 7:
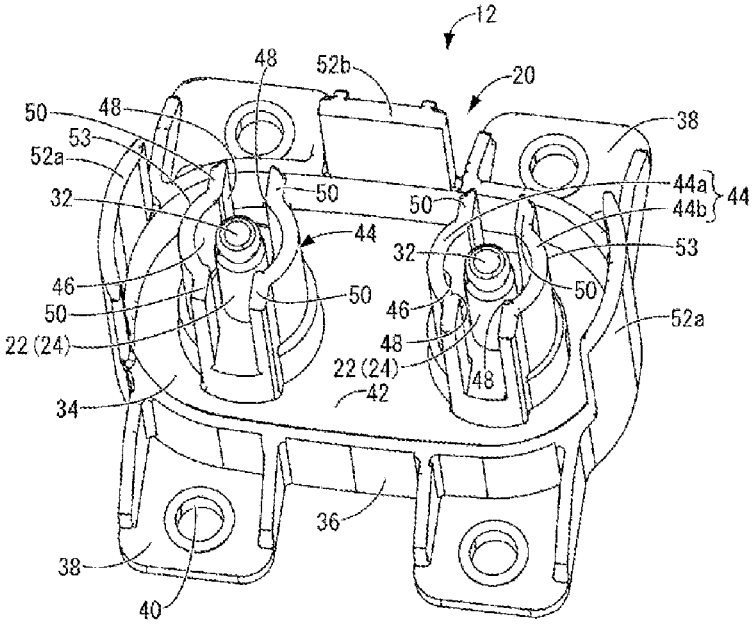
FIG. 7 is an enlarged perspective view of the male connector shown in FIG. 5.
Figure 8:
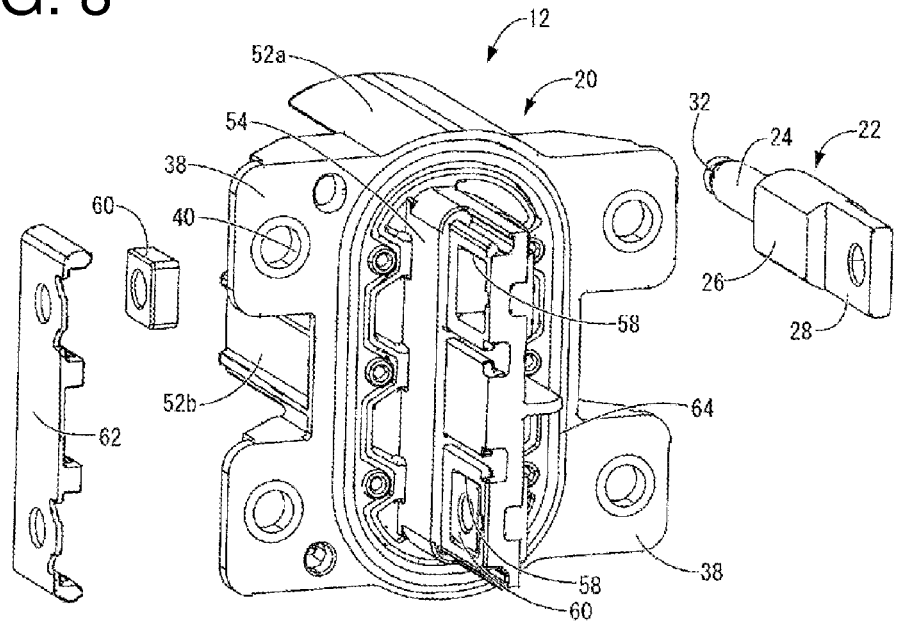
FIG. 8 is an enlarged exploded perspective view of the male connector shown in FIG. 7 viewed from the bottom surface side.

As shown in FIGS. 7 and 8, the male connector 12 is molded with parts of two male terminals 22 made of a conductive metal material embedded in a male housing 20 made of insulating synthetic resin. In FIG. 8, one of the male terminals 22 partially embedded in the male housing 20 is taken out from the male housing 20 to facilitate understanding. The two male terminals 22 have the same shape, and a tip side (back side in FIG. 8) of each serves as a male connecting portion 24 having a substantially solid cylindrical shape. A base end part 26 of the male connecting portion 24 has a substantially solid cylindrical shape having a larger diameter than the male connecting portion 24. A device-side connecting portion 28 substantially in the form of a flat plate projecting toward a rear end side and to be connected to the device side is provided on an end side (front side in FIG. 8) behind the base end part 26. As shown in FIG. 3, an insulating cover portion accommodation hole 30 open toward a tip side (upper side in FIG. 3) is provided in a tip part of the male connecting portion 24. A base end side of an insulating cover portion 32 substantially in the form of a rivet and made of insulating synthetic resin is press-fit into or molded in the insulating cover portion accommodation hole 30 to be fixedly held. In this way, the tip part of the male connecting portion 24 is covered by the insulating cover portion 32. Only the tip part of the male connecting portion 24 of the male terminal 22 is covered by the insulating cover portion 32 having an insulation property, and a part thereof except the tip part is not cover by an insulating member. Therefore, as compared to a conventional structure in which a part except a tip part is covered by an insulating member, conduction safety can be improved by advantageously ensuring a contact area between the male connecting portion 24 and a female connecting portion 70 of a female terminal 72 to be described later. Further, since a cross-sectional area of the male connecting portion 24 itself can be advantageously ensured by the insulating member, the miniaturization of the male connecting portion 24 and that of the male connector 12 are also possible.

The male housing 20 includes a plate-like body portion 34 having a substantially elliptical shape in a plan view. The base end parts 26 of the two male terminals 22 are held embedded at two positions separated in the longitudinal direction (lateral direction in FIG. 7) in a central part of the body portion 34. The male connecting portion 24 of each male terminal 22 projects on a surface of the body portion 34. A peripheral wall 36 projecting upward, i.e. in the same projecting direction as the male connecting portions 24, is provided over the entire periphery on an outer peripheral edge part of the body portion 34. Mounting leg portions 38 projecting outward in the width direction of the body portion 34 from two positions separated in the longitudinal direction of the body portion 34 are formed on each of parts of the outer peripheral surface on both sidewise sides of the peripheral wall 36 facing each other in the width direction (vertical direction in FIG. 7) of the body portion 34. A bolt insertion hole 40 penetrates through each mounting leg portion 38. The surface of the body portion 34 constitutes a female connector mounting surface 42, on which a female housing body 66*a* constituting the female connector 14 to be described later is to be mounted. A pair of tubular bodies 44, 44 surrounding the male connecting portions 24 of the two male terminals 22 arranged at a distance in the longitudinal direction of the body portion 34 from an outer peripheral side are respectively provided to project upward in a central part of the female connector mounting surface 42. Each tubular body 44 includes a pair of semicircular plate portions 44*a*, 44*b* curved substantially along the outer peripheral surface of the male connecting portion 24 of the male terminal 22. The pair of semicircular plate portions 44*a*, 44*b* are facing each other across a gap in a radial direction of the male connecting portion 24, circumferential edge parts of the semicircular plate portion 44*a* and those of the semicircular plate portion 44*b* are facing each other across gaps in a circumferential direction. A female terminal accommodation gap 46 is formed between each male connecting portion 24 and the facing surface of each tubular body 44. A pair of female terminal accommodation holes 48, 48 open in the side surface and projecting end surface of the tubular body 44 are formed at two positions (upper and lower sides in FIG. 7) facing each other in a radial direction of the tubular body 44 by gaps across which the pair of semicircular plate portions 44*a*, 44*b* are facing each other in the circumferential direction. The female terminal accommodation gap 46 and the female terminal accommodation holes 48 are dimensioned to allow the insertion of the female terminal 72 including the female connecting portion 70 in the mating female connector 14 to be described later while preventing hand contact with the male connecting portion 24. In this embodiment, the tip surface of each tubular body 44 is located above the tip surface of the male connecting portion 24 and below the tip surface of the insulating cover portion 32 (see FIG. 3). Therefore, if a hand approaches from the tip side of the male connecting portion 24, the hand comes into contact with the tip surfaces of the insulating cover portion 32 and the tubular body 44, thereby hindering hand contact with the male connecting portion 24.

As shown in FIG. 7, in each tubular body 44, the respective circumferential edge parts of the semicircular plate portions 44*a*, 44*b* defining each female terminal accommodation hole 48 are provided with a pair of contact preventing ribs 50, 50 projecting radially outward, i.e. toward an outer peripheral side of each tubular body 44. Since the female terminal accommodation hole 48 is configured to include the pair of contact preventing ribs 50, 50 in this embodiment, a hand can be kept more away from the male connecting portion 24 by a projecting dimension of the contact preventing ribs 50 toward the outer peripheral side. By providing the contact preventing ribs 50, a large separation dimension in the circumferential direction between the circumferential edge parts of the semicircular plate portions 44*a*, 44*b* defining each female terminal accommodation hole 48 can be ensured while the hand-contact preventing function is ensured. Therefore, a degree of freedom in designing the mating female terminal 72 of the mating partner of the male connector 12 can be ensured. In addition, by providing the pair of contact preventing ribs 50, 50, the rigidity and durability of the tubular body 44 reduced by providing the female terminal accommodation holes 48 in the form of cutouts can be improved.

Further, as shown in FIG. 7, plate-like male-side housing fitting portions 52*a*, 52*a* connected to the peripheral wall 36, projecting further upward than the peripheral wall and curved into an arcuate shape are provided to project in parts of the peripheral wall 36 facing each other in the longitudinal direction of the body portion 34. Furthermore, a male-side housing fitting portion 52*b* in the form of a flat plate connected to the peripheral wall 36 and projecting further upward than the peripheral wall is also provided to project in a part of the peripheral wall 36 located on one widthwise side (upper side in FIG. 7) of the body portion 34. A region between the tubular bodies 44 and the male-side housing fitting portions 52*a*, 52*a* and 52*b* serves as a female housing accommodating portion 53 for accommodating the female housing body 66*a* constituting a female housing 66 of the female connector 14 to be described later. In the male housing 20, the male connecting portions 24 and the tubular bodies 44 surrounding the male connecting portions 24 are provided to project from the central part of the female connector mounting surface 42. The male-side housing fitting portions 52*a*, 52*a* and 52*b* are provided to project on the peripheral edge part of the female connector mounting surface 42, and the female housing accommodating portion 53 is formed, utilizing the space between the tubular bodies 44 and the male-side housing fitting portions 52*a*, 52*a* and 52*b*.

As shown in FIG. 3, projecting dimensions of the male-side housing fitting portions 52*a*, 52*a* and 52*b* from the female connector mounting surface 42 are equal to each other and larger than projecting dimensions of the male connecting portions 24 and the tubular bodies 44 from the female connector mounting surface 42. The female housing 66 includes male connecting portion inserting portions 116 and tubular body inserting portions 118 to be described later, and the female terminals 72 including the female connecting portions 70 are held positioned between the male connecting portion inserting portions 116 and the tubular body inserting portions 118. Projecting heights of the male-side housing fitting portions 52*a*, 52*a* and 52*b* are set larger than those of the male connecting portions 24 and the tubular bodies 44. In this way, a guiding function of guiding the fitting of the male-side housing fitting portions 52*a*, 52*a* and 52*b* to later-described female-side housing fitting portions 146*a*, 146*a* and 146*b* provided on the female connector 14 is achieved. Thus, the male terminals 22 can be advantageously and easily positioned in the female terminal accommodation gaps 46 and the female terminal accommodation holes 48. Therefore, even if the female terminal accommodation gaps 46 and the female terminal accommodation holes 48 have to be narrowed to prevent hand contact, the smooth assembling of the male connector 12 and the female connector 14 can be stably realized.

A substantially block-like embedding portion 54 in which the base end parts 26 of the two male terminals 22 and the device-side connecting portions 28 are embedded is provided to project on the back surface of the body portion 34 of the male housing 20 opposite to the female connector mounting surface 42. The embedding portion 54 is formed with a pair of openings 58, 58 and the device-side connecting portions 28 of the respective male terminals 22 are exposed to outside through the respective openings 58. A nut 60 made of metal and arranged to overlap the device-side connecting portion 28 is accommodated in each opening 58. A lid body 62 made of synthetic resin for covering the pair of openings 58 is assembled with the embedding portion 54, and the nuts 60 accommodated in the respective openings 58 are held accommodated. A through hole for bolt-fixing the mating connecting portion to the nut 60 penetrates through any of the device-side connecting portions 28, the nuts 60 and the lid body 62. A ring-shaped waterproof member 64 extending substantially over the entire periphery of the outer peripheral edge part is mounted on the back surface opposite to the female connector mounting surface 42.

Figure 9:
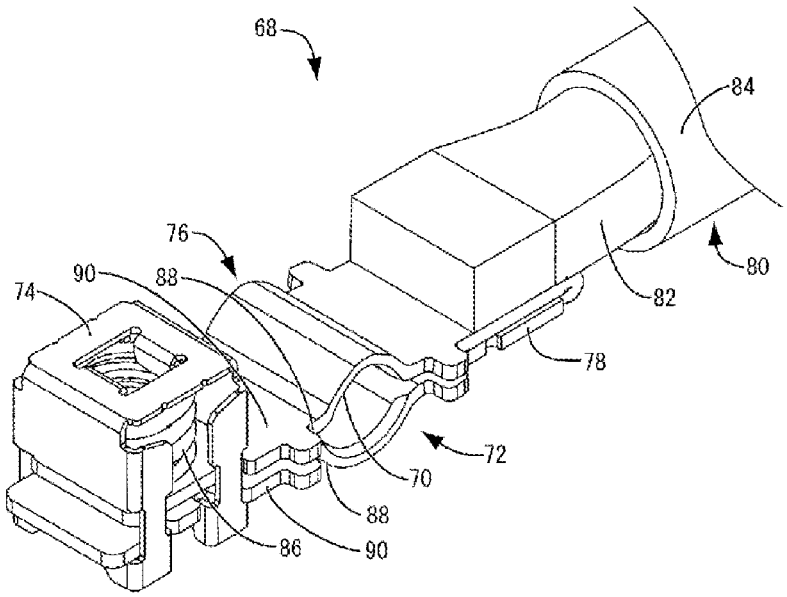
FIG. 9 is an enlarged perspective view showing a female terminal used in the female connector of FIG. 1.

In the female connector 14, two female terminal-equipped wires 68 are positioned and accommodated in the female housing 66 made of insulating synthetic resin. As shown in FIG. 9, the female terminal-equipped wire 68 includes the female terminal 72 made of conductive metal and having the female connecting portion 70 to be connected to the male connecting portion 24 of the male terminal 22 having a substantially cylindrical pin shape. The female terminal-equipped wire 68 includes a spring accommodation case 74 to be assembled with the female terminal 72 and having an accommodation space. In this embodiment, the female terminal 72 is formed, using a strip-like metal flat plate, and one longitudinal end part of the metal flat plate is folded into two toward the other end part. By curving longitudinal intermediate parts of overlapping surfaces in directions separating from each other, a substantially hollow cylindrical male terminal insertion tube portion 76 is formed. The female connecting portion 70 is constituted by the inner surface of this male terminal insertion tube portion 76.

One end side of the female terminal 72 where the part of the metal flat plate folded into two is located serves as a wire connecting portion 78, and a core 82 of a wire 80 is connected to the wire connecting portion 78. The wire 80 is structured such that the core 82 formed by stranding a plurality of metal wires made of copper, aluminum or another metal, which is a conductor, is covered by an insulation coating 82 made of ethylene resin, styrene resin or the like having an electrical insulation property. The core 82 exposed by stripping the insulation coating 84 on an end of the wire 80 is fixed to the wire connecting portion 78 of the female terminal 72 using a known technique such as resistance welding, whereby the core 82 of the wire 80 is connected to the female terminal 72.

The spring accommodation case 74 is assembled with the female terminal 72. The spring accommodation case 74 is so assembled with the female terminal 72 that the accommodation space is disposed above the part of the female terminal 72 where the one longitudinal end part of the metal flat plate is folded into two toward the other end part. A coil spring 86 made of metal is accommodated in a compressed state in the accommodation space of the assembled spring accommodation case 74, and the overlapping one and other end parts of the metal flat plate are biased in a direction to approach each other by the coil spring 86.

Specifically, the female terminal 72 constituting the female terminal-equipped wire 68 includes the male terminal insertion tube portion 76 into which the male connecting portion 24 is to be press-fit, and the female connecting portion 70 is constituted by the inner surface of the male terminal insertion tube portion 76. Thus, by pressing the male connecting portion 24 of the male terminal 22 into contact with the inner surface of the male terminal insertion tube portion 76 of the female terminal 72, the female terminal 72 is connected to the male terminal 22. The female terminal 72 is provided with a pair of first separated portions 88, 88 by separating one circumferential part (left side in FIG. 9) of the male terminal insertion tube portion 76 over the entire length in an axial direction. A pair of overlapping plate portions 90, 90 substantially in the form of flat plates projecting outward (toward an oblique left-lower side in FIG. 9) while being separated from each other are connected to the pair of first separated portions 88, 88. The coil spring 86 constituting a biasing means for biasing the pair of overlapping plate portions 90, 90 in a direction to overlap the overlapping plate portions 90, 90 each other and held in the spring accommodation case 74 is mounted on the pair of overlapping plate portions 90, 90 substantially in the form of flat plates. The male terminal insertion tube portion 76 is held in a diameter reduced state by this biasing means. Specifically, in press-fitting the male connecting portion 24 into the male terminal insertion tube portion 76, the male terminal insertion tube portion 76 is resiliently deformed in a diameter enlarging direction against a biasing force of the coil spring 86 constituting the biasing means to allow the male connecting portion 24 to be press-fit into the male terminal insertion tube portion 76.

According to the female terminal 72 of this embodiment, a force in a diameter reducing direction is applied to the male terminal insertion tube portion 76 by the biasing force of the coil spring 86 constituting the biasing means. Thus, the female connecting portion 70 constituted by the inner surface of the male terminal insertion tube portion 76 can be pressed into contact with the male connecting portion 24 press-fit into the male terminal insertion tube portion 76 with a large contact pressure. Since the coil spring 86 constituting the biasing means is assembled with the female terminal 72 in advance, it is not necessary to mount a separate spring member or the like as before to ensure a contact pressure between the male and female terminals after the male terminal 22 is connected to the female terminal 72. Therefore, connection by a high contact pressure of the male terminal 22 and the female terminal 72 can be realized by excellent workability. In addition, the male terminal insertion tube portion 76 is allowed to be resiliently deformed in the diameter enlarging direction against the biasing force of the coil spring 86. In this way, a press-contact state can be stably maintained while an insertion force in press-fitting the male connecting portion 24 into the female connecting portion 70 is advantageously reduced.

Figure 12:
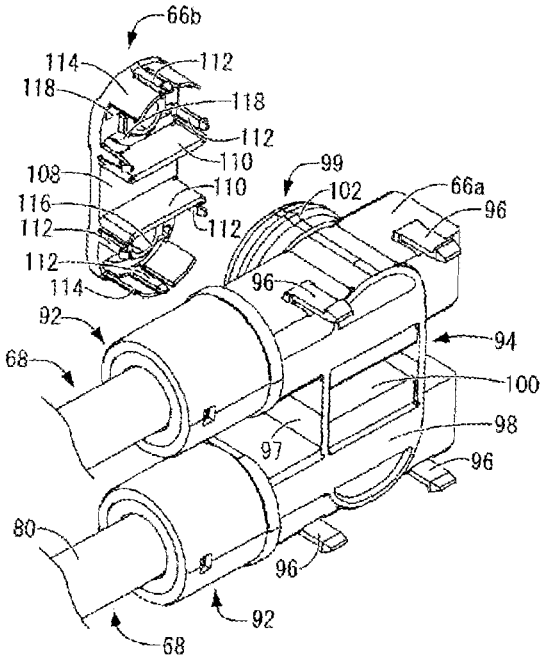
FIG. 12 is an exploded perspective view showing a state where a female lower cover is assembled with the female housing body having the female terminals shown in FIG. 10 mounted therein.
Figure 14:
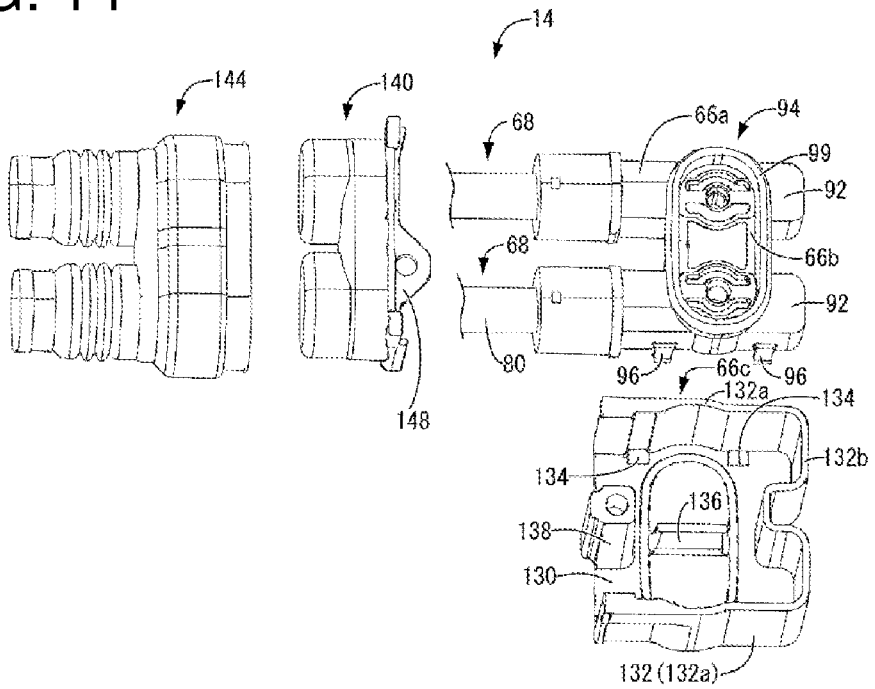
FIG. 14 is an exploded perspective view showing a state where the female connector is completed by assembling a female upper cover and the like with the assembly of the female lower cover with the female housing body shown in FIG. 12.

The two female terminal-equipped wires 68 are held positioned with respect to the female housing 66, thereby configuring the female connector 14. As shown in FIGS. 3, 12, 14 and the like, the female housing 66 is configured to include the female housing body 66*a* for accommodating and holding the two female terminal-equipped wires 68, a female lower cover 66*b* for covering the female housing body 66*a* from below and a female upper cover 66*c* for covering the female housing body 66*a* from above.

Figure 10:
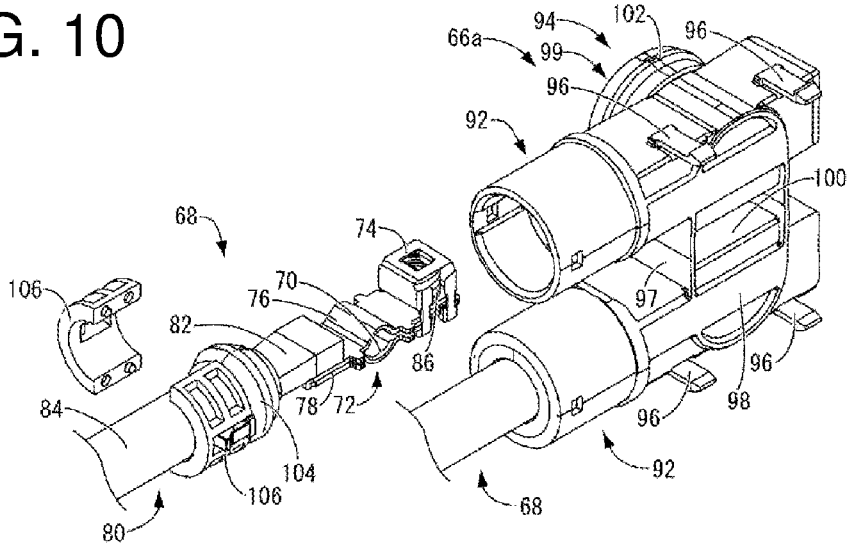
FIG. 10 is an exploded perspective view showing a state where the female terminal shown in FIG. 9 is being mounted into a female housing body of the female connector.
Figure 11:
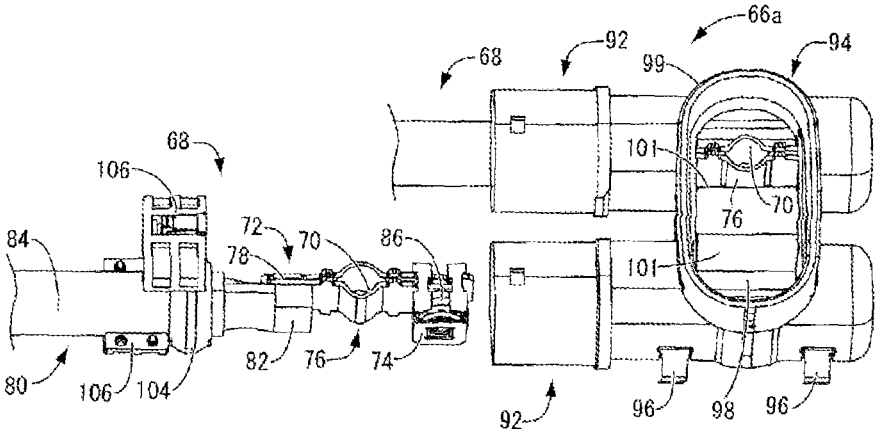
FIG. 11 is an exploded perspective view of FIG. 10 viewed from the bottom surface side.

As shown in FIGS. 10 and 11, the female housing body 66*a* includes two substantially hollow cylindrical female terminal accommodation tube portions 92 for respectively accommodating and holding the two female terminal-equipped wires 68, and a coupling tube portion 94 coupling the two female terminal accommodation tube portions 92. Each female terminal accommodation tube portion 92 has an open base end side to enable the female terminal-equipped wire 68 to be accommodated inside. The coupling tube portion 94 is provided to straddle between the two female terminal accommodation tube portions 92 so that lengthwise intermediate parts of the two female terminal accommodation tube portions 92 arranged in parallel across a gap are coupled. Engaging portions 96 are provided to project at two positions separated in a length direction of the female terminal accommodation tube portion 92 on a side surface of each female terminal accommodation tube portion 92 located on an outer side in a juxtaposition direction of the two female terminal accommodation tube portions 92. The engaging portions 96 are cantilevered upward (right side in FIG. 10), toward which the female upper cover 66*c* is to be mounted, and engaging projections are formed on projecting end parts. As shown in FIGS. 10 and 12, the coupling tube portion 94 includes a central coupling portion 97 coupling facing side surfaces of the two female terminal accommodation tube portions 92 in the juxtaposition direction, a ceiling wall portion 98 connected to the central coupling portion 97 and expanding over the upper surfaces of the two female terminal accommodation tube portions 92 (surfaces on projecting sides of the engaging portions 96), and a tubular receptacle 99 connected to the central coupling portion 97 and expanding over the lower surfaces of the two female terminal accommodation tube portions 92 (surfaces on which the female lower cover 66*b* is to be mounted). A recess 100 provided in the central coupling portion 97 is open in a central part of the ceiling wall portion 98. The tubular receptacle 99 has a substantially elliptical shape in a bottom view of the female housing body 66*a* (see FIGS. 11 and 13), and opening windows 101 provided in the lower surfaces of the respective female terminal accommodation tube portions 92 are surrounded by the tubular receptacle 99. A ring-shaped waterproof member 102 made of rubber is mounted on the outer peripheral surface of the tubular receptacle 99. The female terminal 72 of the female terminal-equipped wire 68 is press-fit into each female terminal accommodation tube portion 92 of the female housing body 66*a* through an opening on the base end side of the female terminal accommodation tube portion 92. A substantially ring-shaped waterproof member 104 made of synthetic resin and a pair of substantially semicylindrical fixing members 106, 106 made of synthetic resin are assembled on the insulation coating 84 of the wire 80 of the female terminal-equipped wire 68 successively from the side of the female terminal 72. As shown in FIG. 11, the female terminal 72 is so accommodated that an axial direction of the male terminal insertion tube portion 76 is aligned with a vertical direction of the female terminal accommodation tube portion 92, and one opening of the male terminal insertion tube portion 76 is exposed to outside via the opening window 101.

Figure 13:
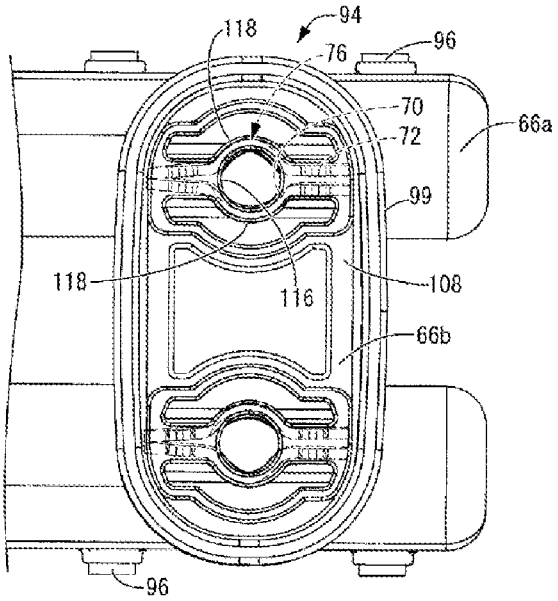
FIG. 13 is a partial enlarged perspective view showing an assembly of the female lower cover with the female housing body shown in FIG. 12 and having the female terminals mounted therein when viewed from the bottom surface side.

Subsequently, the female lower cover 66*b* is assembled with the tubular receptacle 99 in the coupling tube portion 94 of the female housing body 66*a*, and the opening windows 101 provided in the respective female terminal accommodation tube portions 92 are covered by the female lower cover 66*b*. As shown in FIGS. 12 and 13, the female lower cover 66*b* includes a substantially elliptical bottom wall portion 108 formed to have a size capable of being accommodated into the tubular receptacle 99 and covering the opening of the tubular receptacle 99. A pair of separation walls 110, 110 separated and facing each other in a longitudinal direction are provided to project in a central part in the longitudinal direction (vertical direction in FIG. 12) of the bottom wall portion 108. Each separation wall 110 extends in a direction orthogonal to the longitudinal direction of the bottom wall portion 108 over the entire length in a width direction of the bottom wall portion 108 and has a substantially rectangular flat plate shape projecting upwardly of the bottom wall portion 108 toward the tubular receptacle 99. Engaging portions 112 cantilevered and formed with engaging projections on projecting end parts are provided near the separation walls 110 on both widthwise edge parts of the bottom wall portion 108. A pair of fitting walls 114, 114 projecting upward while being curved along an outer peripheral edge part are provided on both side edge parts in the longitudinal direction of the bottom wall portion 108. A circumferential central part of each fitting wall 114 is cut. An engaging portion 112 cantilevered and formed with an engaging projection on a projecting end part is also provided in this cut part. As shown in FIG. 13, male connecting portion inserting portions 116 having a substantially circular cross-sectional shape into which the male connecting portions 24 are to be inserted are provided to penetrate through central parts of regions surrounded by the separation walls 110 and the fitting walls 114 in the bottom wall portion 108. Tubular body inserting portions 118, into which the tubular body 44 is to be inserted and which has a substantially arcuate cross-sectional shape, are provided to penetrate on both sides across the male connecting portion inserting portion 116. The female lower cover 66*b* is assembled while being inserted into the tubular receptacle 99. At that time, the engaging portions 112 provided on the female lower cover 66*b* are engaged with engaged portions 120 (see FIG. 3) provided on the female housing body 66*a*. In this way, the female lower cover 66*b* is fixed to the female housing body 66*a*. As shown in FIG. 13, the female terminals 72 including the female connecting portions 70 are held positioned between the male connecting portion inserting portions 116 and the tubular body inserting portions 118. The male terminal insertion tube portions 76 of the female terminals 72 exposed through the opening windows 101 are arranged below and substantially coaxially with the male connecting portion inserting portions 116.

Figure 4:
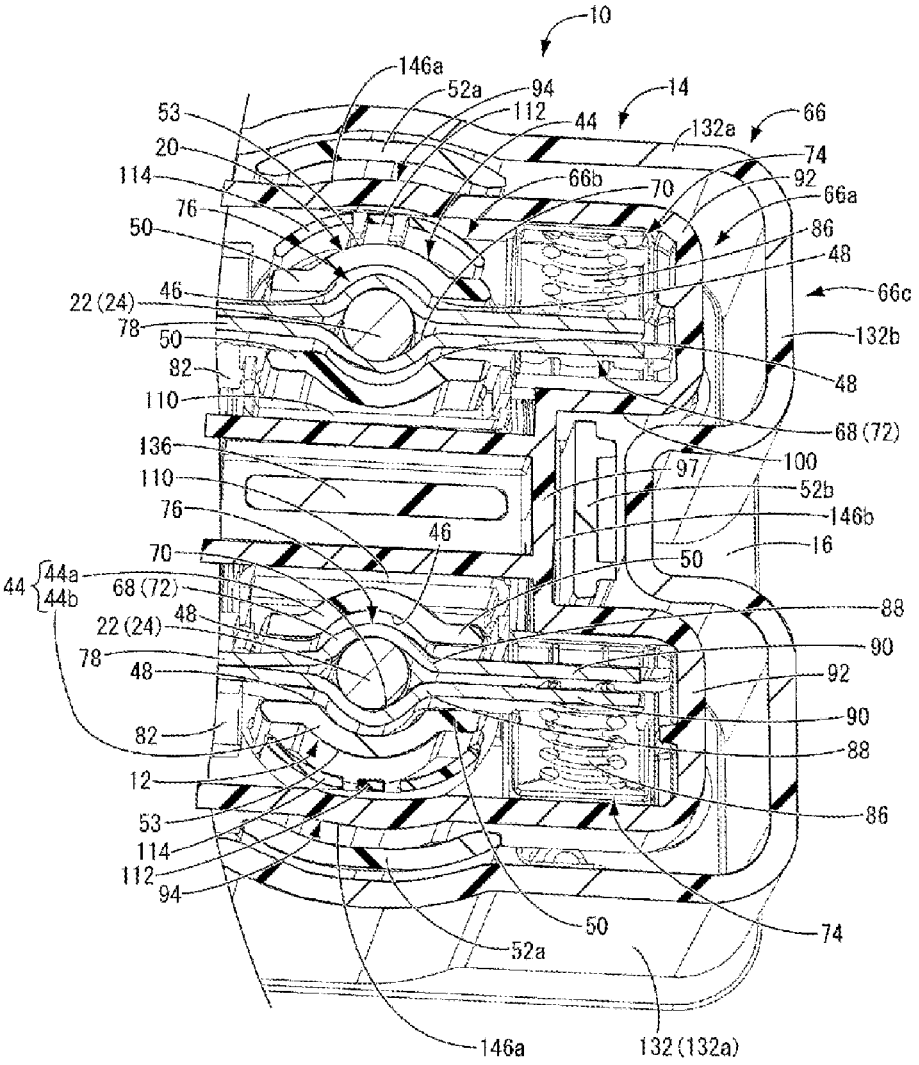
FIG. 4 is an enlarged section along IV-IV in FIG. 1.
Figure 5:
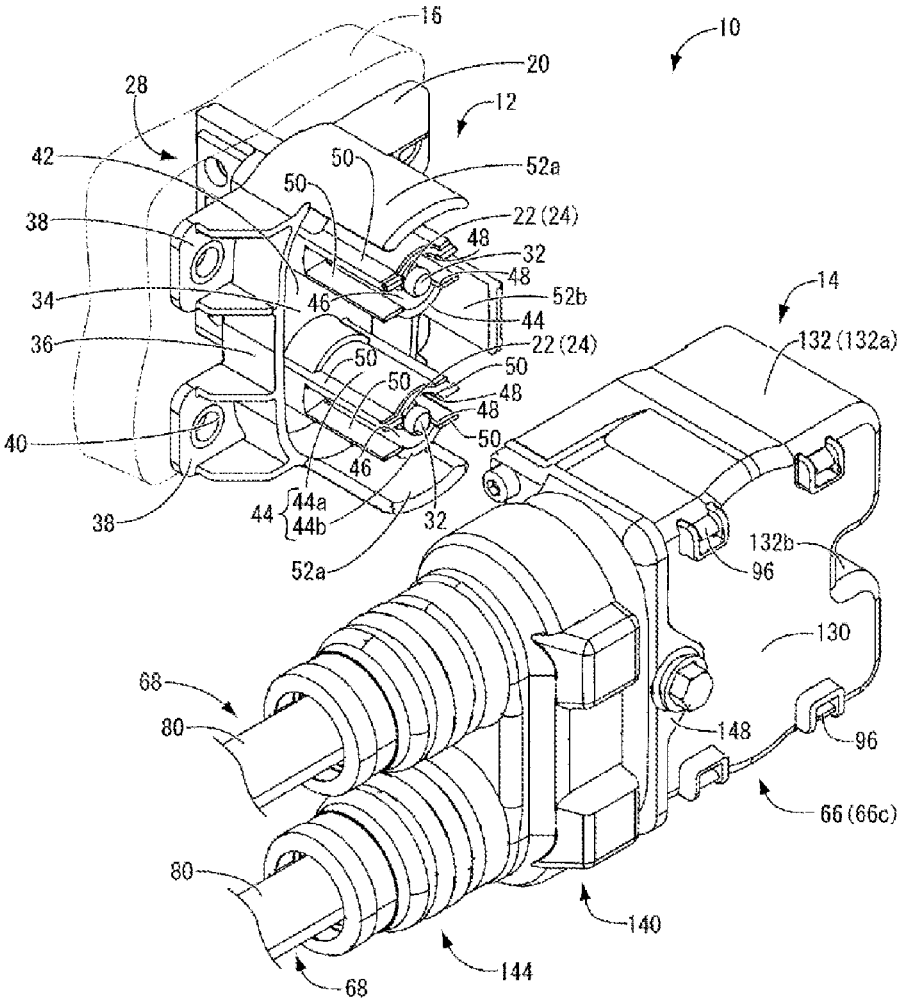
FIG. 5 is an enlarged exploded perspective view showing the connection of a male connector and a female connector of the one embodiment.
Figure 6:
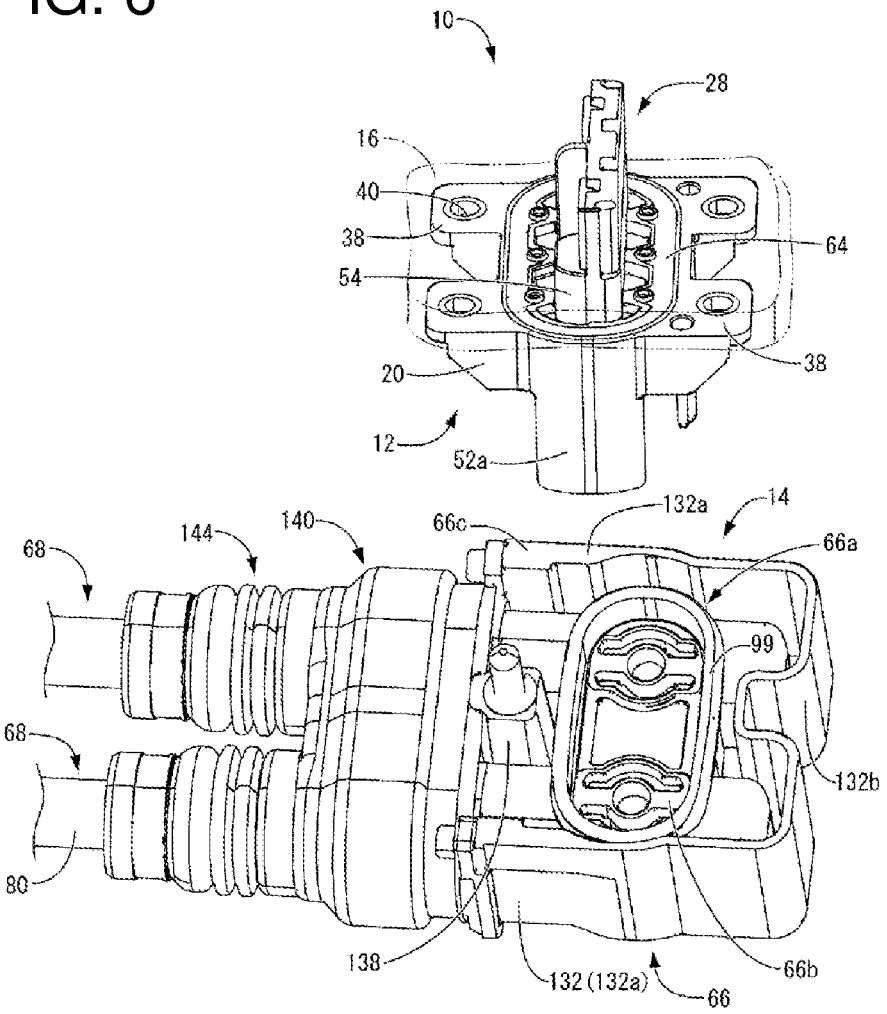
FIG. 6 is an enlarged exploded perspective view of the male connector and the female connector shown in FIG. 5 respectively viewed from the bottom surface side.

Subsequently, the female upper cover 66*c* is assembled with the female housing body 66*a* assembled with the female lower cover 66*b*. As shown in FIG. 14, the female upper cover 66*c* includes a ceiling wall portion 130 substantially in the form of a rectangular flat plate and a peripheral wall 132 projecting toward the female housing body 66*a* from an outer peripheral edge part of the ceiling wall portion 130. The peripheral wall 132 is composed of a pair of side walls 132*a*, 132*a* (upper and lower walls in FIG. 14) for surrounding both side surfaces of the female housing body 66*a* and a front wall 132*b* (right wall in FIG. 14) for covering the tip surface of the female housing body 66*a*. No peripheral wall 132 is provided on a rear side (left side in FIG. 14) of the ceiling wall portion 130 corresponding to base end sides of the female terminal accommodation tube portions 92, 92. Engaged portions 134 having a substantially rectangular cross-sectional shape are provided to penetrate at four positions corresponding to the engaging portions 96 of the female housing body 66*a* on the outer peripheral edge part of the ceiling wall portion 130. A projection 136 having a substantially triangular cross-sectional shape and extending forward from behind the ceiling wall portion 130 is formed in a central part of the ceiling wall portion 130. A bolt fixing portion 138 is provided to project in a central part of a rear side of the ceiling wall portion 130. The female upper cover 66*c* is mounted from above the female housing body 66*a* (lower side in FIG. 14) to cover the female housing body 66*a* with the female upper cover 66*c*. At this time, the projection 136 of the female upper cover 66*c* is accommodated into the recess 100 of the central coupling portion 97 of the female housing body 66*a*. In this way, the engaging portions 96 of the female housing body 66*a* are engaged with the engaged portions 134 of the female upper cover 66*c* and the female housing body 66*a* is held on the female upper cover 66*c*. Subsequently, an intermediate member 140 including a pair of wire insertion tube portions and externally fit to the female terminal accommodation tube portions 92 to be fixed are assembled with the female terminal accommodation tube portions 92 of the female housing body 66*a*. A mounting member 144 configured to mount a shield member 142 (see FIGS. 1 and 2) for covering the wires 80 and including a pair of wire insertion tube portions is externally fit to the intermediate member 140 to be fixed. The female connector 14 is completed in which the female terminal-equipped wires 68 are accommodated and arranged in the female housing body 66*a*, the female lower cover 66*b* and the female upper cover 66*c* constituting the female housing 66. In this female connector 14, as shown in FIG. 4, the pair of female-side housing fitting portions 146*a*, 146*a* are formed in facing gaps between the pair of side walls 132*a*, 132*a* of the female upper cover 66*c* and both side surfaces of the female housing body 66. The female-side housing fitting portion 146*b* is also formed between the front wall 132*b* of the female upper cover 66*c* and the tip surface of the female housing body 66*a*.

With the female lower cover 66*b* of the female connector 14 caused to face the female connector mounting surface 42 of the male connector 12, the female connector 14 is fit into the male connector 12. At this time, the male-side housing fitting portions 52*a*, 52*a* and 52*b* are first fit to the female-side housing fitting portions 146*a*, 146*a* and 146*b* (see FIG. 4). In this way, the female connecting portions 70 of the female terminals 72 of the female connector 14 and regions near the female connecting portions 70 are positioned with respect to the female terminal accommodation gaps 46 and the female terminal accommodation holes 48 of the male connector 12. In addition, the male connecting portion inserting portions 116 and the tubular body inserting portions 118 of the female connector 14 are positioned with respect to the male connecting portions 24 and the tubular bodies 44 of the male connector 12. By fitting the female connector 14 to the male connector 12 with such a positioned state maintained, the female connecting portions 70 of the female terminals 72 are accommodated into the female terminal accommodation gaps 46 and pressed into contact with the outer peripheral surfaces of the male connecting portions 24. The male connecting portions 24 and the tubular bodies 44 of the male connector 12 are accommodated into the male connecting portion inserting portions 116 and the tubular body inserting portions 118 of the female connector 14. With the male connector 12 and the female connector 14 connected, the wire connecting portions 78 of the female terminals 72 are accommodated outside the tubular bodies 44 (left side in FIG. 4) as shown in FIG. 4. The wires 80 extending from the wire connecting portions 78 of the female terminals 72 extend outward of the female terminal accommodation holes 48 in a direction orthogonal to the projecting direction of the tubular bodies 44 (see FIGS. 1 and 4). The coil springs 86 of the female terminals 72 are also accommodated outside the tubular bodies 44 of the male connector 12 (right side in FIG. 4). The coil springs 86 constituting the biasing means may become larger, but the biasing means can be accommodated outside the tubular bodies 44. In this way, both an improvement of the press-contact state of the female terminals 72 and the male terminals 22 and a reduction of an insertion force can be achieved while the hand contact preventing function by the tubular bodies 44 is maintained. With the male connector 12 and the female connector 14 connected, through holes of a fixing portion 148 (see FIG. 14) provided on the intermediate member 140 and the bolt fixing portion 138 provided on the female upper cover 66*c* are aligned with each other, and a bolt is fastened to a fastening part of the mounting body 16. In this way, the intermediate member 140 and the female upper cover 66*c* are mounted on the mounting body 16. As a result, the male connector 12 and the female connector 14 are mounted on the mounting body 16 while being connected.

According to the male connector 12 and the connector device 10, the tubular bodies 44 surrounding the male connecting portions 24 are provided to project on the body portion 34 of the male connector 12 on which the male connecting portions 24 of the male terminals 22 project. The tubular body 44 is provided with the female terminal accommodation holes 48 open in the projecting end surface and the side surface (at two positions in this embodiment). The female terminal accommodation gap 46 is formed between the male connecting portion 24 and the facing surface of the tubular body 44. The female terminal accommodation gap 46 and the female terminal accommodation holes 48 are configured to allow the insertion of the female terminal 72 including the female connecting portion 70 to be connected to the male connecting portion 24 in the female connector 14 while hindering hand contact with the male connecting portion 24. The female terminal 72 including the female connecting portion 70 can be accommodated and arranged in the female terminal accommodation gap 46 and the female terminal accommodation holes 48. In this way, projecting dimensions of the female terminals 72 and the female connector 14 including the female terminals 72 from the male connector 12 can be reduced, and a height reduction of the connector device 10 can be advantageously realized. In addition, the female terminal accommodation gap 46 and the female terminal accommodation holes 48 are dimensioned to hinder hand contact with the male connecting portion 24. In this way, even if the tubular body 44 is formed with the female terminal accommodation holes 48 as in this embodiment, hand contact with the male connecting portion 24 is reliably prevented. Since the tip part of the male connecting portion 24 is covered by the insulating cover portion 32, even if a hand approaches from the tip side of the male connecting portion 24, hand contact with the male connecting portion 24 is prevented by the cooperation of the insulating cover portion 32 and the tubular body 44.

According to the connector device 10 of this embodiment, the female terminals 72 including the female connecting portions 70 are held positioned between the male connecting portion inserting portions 116 and the tubular body inserting portions 118 in the female connector 14. In this way, the insertion of the male connecting portions 24 and the tubular bodies 44 of the male connector 12 into the female housing 66 of the female connector 14 is allowed in assembling the female connector 14 from above in the axial direction of the male connecting portions 24 and the tubular bodies 44 of the male connector 12. Thus, the female terminals 72 including the female connecting portions 70 can be smoothly accommodated and arranged in the female terminal accommodation gaps 46 and the female terminal accommodation holes 48 of the male connector 12. The compact connector device 10 reduced in height can be advantageously realized by a simple structure. The female connecting portion 70 that can be formed to be relatively thin and the region near the female connecting portion 70 in the female terminal 72 are accommodated and the arranged in the female terminal accommodation gap 46 and the female terminal accommodation holes 48. The wire connecting portion 78 that is formed to be relatively thick and the spring accommodation case 74 are accommodated and arranged outside the tubular body 44. In this way, the dimensions of the female terminal accommodation gap 46 and the female terminal accommodation holes 48 can be maximally reduced and the hand-contact preventing function can be reliably realized.

The wire 80 extending from the wire connecting portion 78 of the female terminal 72 is arranged to extend outwardly of the female terminal accommodation hole 48 in the direction orthogonal to the projecting direction of the tubular body 44. In this way, the extension of the wire 80 axially upwardly of the tubular body 44 and the like can be avoided. Thus, a height reduction of the entire connector device 10 using the male connector 12 can be more advantageously realized. In addition, when the male connector 12 and the female connector 14 are connected, the male-side housing fitting portions 52*a*, 52*a* and 52*b* and the female-side housing fitting portions 146*a*, 146*a* and 146*b* are first fit. In this way, the female terminals 72 of the female connector 14 are positioned with respect to the female terminal accommodation gaps 46 and the female terminal accommodation holes 48 of the male connector 12. The male connecting portion inserting portions 116 and the tubular body inserting portions 118 of the female connector 14 are positioned with respect to the male connecting portions 24 and the tubular bodies 44 of the male connector 12. Specifically, the guiding function by the mutual fitting of the male-side housing fitting portions 52*a*, 52*a* and 52*b* and the female-side housing fitting portions 146*a*, 146*a* and 146*b* is achieved, and the insertion of the female terminals 72, the male connecting portions 24 and the tubular bodies 44 into narrow gaps is stably realized. Both the realization of a height reduction of the connector device 10 and ease of fitting are advantageously realized by a simple structure.

<Miscellaneous>

Although the embodiment has been described in detail above as a specific example of the present disclosure, the present disclosure is not limited to this specific description. Modifications, improvements and the like within a range capable of achieving the aim of the present disclosure are included in the present disclosure. For example, the following embodiments are also included in the technical scope of the present disclosure.

(1) Although the male connecting portion 24 is in the form of a pin in the above embodiment, a male connecting portion having a flat shape or the like can be employed.

(2) Although the female terminal accommodation holes 48 are provided at two positions in the above embodiment, female terminal accommodation hole(s) may be provided at one or three positions.

(3) The present disclosure may be configured such that the female terminal accommodation gap 46 and the female terminal accommodation holes 48 defined by the tubular body 44 are dimensioned to allow the insertion of the female connecting portion 70 and hinder hand contact with the male terminal 22. It goes without saying that arbitrary configurations can be adopted for the other housings, male and female terminals, wires and the like.

LIST OF REFERENCE NUMERALS

10: connector device, 12: male connector, 14: female connector, 20: male housing, 22: male terminal, 24: male connecting portion, 32: insulating cover portion, 34: body portion, 42: female connector mounting surface, 44: tubular body, 44*a*, 44*b*: semicircular plate portion (tubular body), 46: female terminal accommodation gap, 48: female terminal accommodation hole, 50: contact preventing rib, 52*a*, 52*b*: male-side housing fitting portion, 53: female housing accommodating portion, 66: female housing, 66*a*: female housing body (female housing), 66*b*: female lower cover (female housing), 66*c*: female upper cover (female housing), 70: female connecting portion, 72: female terminal, 76: male terminal insertion tube portion, 78: wire connecting portion, 80: wire, 86: coil spring (biasing means), 88: first separated portion, 90: overlapping plate portion, 116: male connecting portion inserting portion, 118: tubular body inserting portion

What is claimed is:

1. A male connector, comprising:

a male terminal held in a male housing;

a tubular body including a pair of semicircular plates each projecting on the male housing, and surrounding a male connecting portion of the male terminal;

an insulating cover portion configured to cover a tip part of the male connecting portion of the male terminal;

a female terminal accommodation gap formed between the male connecting portion of the male terminal and a facing surface of the tubular body; and a female terminal accommodation hole defined by a pair of circumferential edge parts of the pair of semicircular plates of the tubular body, and open in a projecting direction and a side direction of the pair of semicircular plates of the tubular body, wherein the female terminal accommodation gap and the female terminal accommodation hole are configured to allow insertion of a female terminal including a female connecting portion to be connected to the male connecting portion in a mating female connector while hindering hand contact with the male connecting portion.

2. The male connector according to claim 1, wherein a part of the male connecting portion of the male terminal except the tip part is not covered by an insulating member.

3. The male connector according to claim 1, further comprising:

a pair of contact preventing ribs projecting toward an outer peripheral side of the tubular body from the pair of circumferential edge parts of the pair of semicircular plates, respectively, wherein the female terminal accommodation hole is configured to include the pair of contact preventing ribs.

4. The male connector according to claim 1, wherein:

the male housing includes a body portion configured to accommodate a base end part of the male terminal, the body portion has a female connector mounting surface on which the female connector is to be mounted, the male connecting portion of the male terminal and the tubular body surrounding the male connecting portion are provided to project in a central part of the female connector mounting surface, a male-side housing fitting portion projecting in the same direction as the tubular body is provided to project on a peripheral edge part of the female connector mounting surface, and a region between the tubular body and the male-side housing fitting portion serves as a female housing accommodating portion configured to accommodate a female housing of the female connector.

5. The male connector according to claim 4, wherein:

a projecting dimension of the male-side housing fitting portion from the female connector mounting surface is larger than projecting dimensions of the male connecting portion and the tubular body from the female connector mounting surface, and the male-side housing fitting portion is fit to a female-side housing fitting portion provided in the female housing, whereby the female terminal of the female connector is positioned in the female terminal accommodation gap and the female terminal accommodation hole.

6. A connector device, comprising:

a male connector according to claim 5; and a female connector to be connected to the male connector, wherein:

the female connector includes a female terminal including a female connecting portion to be connected to the male connecting portion of the male terminal and a female housing configured to accommodate the female terminal, and the female housing includes a male connecting portion inserting portion and a tubular body inserting portion and the female terminal including the female connecting portion is held positioned between the male connecting portion inserting portion and the tubular body inserting portion.

7. The connector device according to claim 6, wherein the female connecting portion of the female terminal and a region near the female connecting portion are accommodated in the female terminal accommodation gap and the female terminal accommodation hole provided in the male connector, and a wire connecting portion of the female terminal is accommodated outside the tubular body.

8. The connector device according to claim 7, wherein the female connecting portion of the female terminal is accommodated into the female terminal accommodation gap and pressed into contact with an outer peripheral surface of the male connecting portion, and a wire extending from the wire connecting portion of the female terminal extends outwardly of the female terminal accommodation hole in a direction orthogonal to a projecting direction of the tubular body.

9. The connector device according to claim 8, wherein:

the female terminal of the female connector includes a male terminal insertion tube portion constituting the female connecting portion by an inner surface to which the male connecting portion is to be press-fit, a pair of overlapping plate portions connected to a pair of first separated portions provided by separating one part in a circumferential direction of the male terminal insertion tube portion over an entire length in an axial direction, separated from each other and projecting outward, and a biasing spring held in the female terminal configured to bias the pair of overlapping plate portions in a direction to overlap the overlapping plate portions each other and holding the male terminal insertion tube portion in a diameter reduced state, the male terminal insertion tube portion is resiliently deformed in a diameter enlarging direction against a biasing force of the biasing spring and the male connecting portion is allowed to be press-fit into the male terminal insertion tube portion when the male connecting portion is press-fit into the male terminal insertion tube portion, and the biasing spring of the female terminal is accommodated outside the tubular body of the male connector.

10. The connector device according to claim 8, wherein:

the female housing is formed with a female-side housing fitting portion to which the male-side housing fitting portion is to be fit, and when the male connector and the female connector are connected, the male-side housing fitting portion and the female-side housing fitting portion are fit, whereby the female terminal of the female connector is positioned with respect to the female terminal accommodation gap and the female terminal accommodation hole of the male connector and the male connecting portion inserting portion and the tubular body inserting portion of the female connector are positioned with respect to the male connecting portion and the tubular body of the male connector.

11. The male connector according to claim 1, wherein a pair of female terminal accommodation holes is provided to face with each other in a radial direction of the tubular body.

* * * * *